US005353575A

United States Patent [19]

Stepanek

[11] Patent Number: 5,353,575

[45] Date of Patent: Oct. 11, 1994

[54] TAB CLOSING DEVICE IN A QUICK SHEET FOR WRAPPING

[75] Inventor: Stephen Stepanek, Amerherst, N.H.

[73] Assignee: Hampshire Paper Corp., Milford, N.H.

[21] Appl. No.: 56,175

[22] Filed: May 3, 1993

[51] Int. Cl.[5] ..... B65B 11/48; B65B 11/56

[52] U.S. Cl. ..... 53/461; 53/416; 53/397; 206/423

[58] Field of Search ..... 206/423; 53/415, 416, 53/397, 399, 461

[56] References Cited

U.S. PATENT DOCUMENTS

| | | | |
|---|---|---|---|
| Re. 16,347 | 5/1926 | Bliss | 53/416 |
| 4,398,983 | 8/1983 | Suzuki et al. | 53/399 |
| 5,007,229 | 4/1991 | Weder et al. | 53/461 |
| 5,199,242 | 4/1993 | Weder et al. | 53/461 |

*Primary Examiner*—W. Donald Bray
*Attorney, Agent, or Firm*—Stephen W. White

[57] ABSTRACT

A novel and unique method for the wrapping of an object is described. This method employs a sheet of wrapping material having an upper surface and a lower surface, a first end and a second end and having a tab closure device adhered to one end of said upper surface. When wrapping up an object, the object is laid on the upper surface on an end away from said tab and rolled thereto. The tab closure device comprises a strip of material adhered firmly to the upper surface of said material and folded over, with a small amount of pressure sensitive adhesive applied between the folds. When this is pulled up to exposed the pressure sensitive adhesive, the tab can be used to firmly close the two ends. This material is particularly useful in the quick wrapping of a floral arrangement or grouping.

8 Claims, 2 Drawing Sheets

TAB CLOSING DEVICE IN A QUICK SHEET FOR WRAPPING

BACKGROUND OF THE INVENTION

1. Field of the Invention

This invention relates to the field of wrapping material and particularly to the field of the wrapping of flowers or floral arrangements and the like. Still more particularly, this invention relates wrapping material in which a tab closure device is employed in order to hasten the process.

2. Discussion of the Prior Art

Commercially speaking, the wrapping up of goods for sale and the like is a well-known field. Usually, this is done on a wholesale basis where the item to be wrapped is hand covered with the wrapping material. Most wrapping steps include the act of wrapping the object inside the material and then insuring that this wrapping remains closed either by gluing, tieing, taping or the like.

In the field of floral wrapping, for example, groups or bunches or arrangements of flowers and other decorative material are gathered together by hand and then those particular items wrapped with wrapping material such as paper, foil, plastic and the like. After wrapping, the material may be joined or held together by using either a pre-applied sticky-tape from which a removable cover sheet must be removed or by other physical means such as regular tape applied over the joint or by string or rubber bands, etc. For example, in one prior art method for wrapping of flowers, used for some time, a plurality of separate sheets of wrapping material is placed on the table. Each of these sheets has a pre-applied strip of quick-release, sticky tape adhesive on one end of the sheet. In order to prevent each sheet from sticking together with the neighboring sheet, a small sheet is applied to cover the sticky surface. This cover sheet is usually made from some high gloss material which can be easily removed from the sticky surface. After removal of the cover sheet, the flowers are wrapped in the material and the exposed sticky surface is pressed on to the wrapping material itself in order to insure closure. This is a time consuming step and uses considerable labor intensive work. In the floral industry, where the margin of profit may be small, it is usually imperative that the operative steps of this wrapping process be kept to a minimum. When the wrapping requires separate steps of peeling, tieing, pasting or the like, then the labor cost to the manufacturer increases.

A recently introduced method for wrapping floral arrangements relies on the aforementioned prior art system for furnishing the wrapping material with some sort of adhesive already applied. In this particular case, several sheets of pre-cut wrapping material on which a strip of pressure sensitive adhesive has been applied, are laminated together along and using this strip of adhesive. This is accomplished by placing the back of one sheet (on which there is no adhesive) over the top of another sheet on which the adhesive is exposed, and pressing the sheets together to bond adhesive to back. To use this material for wrapping flowers and the like, the user lays the pad, or laminate of sheets, on the table with a layer of adhesive exposed. The user lays the floral arrangement on a corner of the material away from the adhesive layer and rolls the arrangement towards the adhesive strip wherein a funnel-like system is formed. When the user reaches the adhesive end, the sheet is pulled strongly to remove the sheet o from the pad and the two ends joined by using the adhesive strip to adhere along the fresh, wrapping material. Although this particular process is very similar to that in which individual, tacky sheets with a cover sheet are used, there are significant drawbacks. For example, it sometimes is difficult to separate an individual sheet from the pad. This step requires some pulling and this sometimes distorts the floral arrangement or adds wrinkling to the wrapping material. These are undesirable facts and there has been a long-standing need to furnish a quick-wrap process that provides neat and easy closure thereto.

There is also a long-standing need to furnish a quick wrapping system that can be easily used, quickly closed and which will not require the use separate strings, tapes or twisters and the like, one in which the final wrapping will appear smooth an without tears or wrinkles. Finally, there is a long-standing need, especially in the floral wrapping industry, for a system which can be used to quickly wrap flowers and the like without external closure devices and which avoids the inherent problems of sheets containing sticky layers themselves.

SUMMARY OF THE INVENTION

It is an object of this invention to provide a quick wrap, quick closure system that can be used to wrap objects. It is another object of this invention to provide a quick closure wrapping system particularly useful in the wrapping of flowers and floral arrangements and the like. It is yet another object to provide a floral wrapping system that does not require external closure devices and the like. These and yet other objects are achieved in a method for wrapping an object comprising the steps of:

providing a sheet of material having a first upper and a second lower surface, a first end and a second end, providing a tab closure element on said second end, said tab comprising two sides and at least two sections wherein the first section is firmly adhered on one side to said upper surface closest to said second end of said sheet of material and the second section is folded so as to contact said first section and wherein said second section is coated with a pressure sensitive adhesive on the side contacting said first section, with the proviso that the adherence of said pressure sensitive adhesive is less when in contact with said first section than when in contact with the sheet of material.

In yet another embodiment, the tab closure element may be comprises of three sections wherein two sections are as described above and one section remains as a small pull tab to effect release of the first section from the second section.

DETAILS OF THE INVENTION

Figure 1:
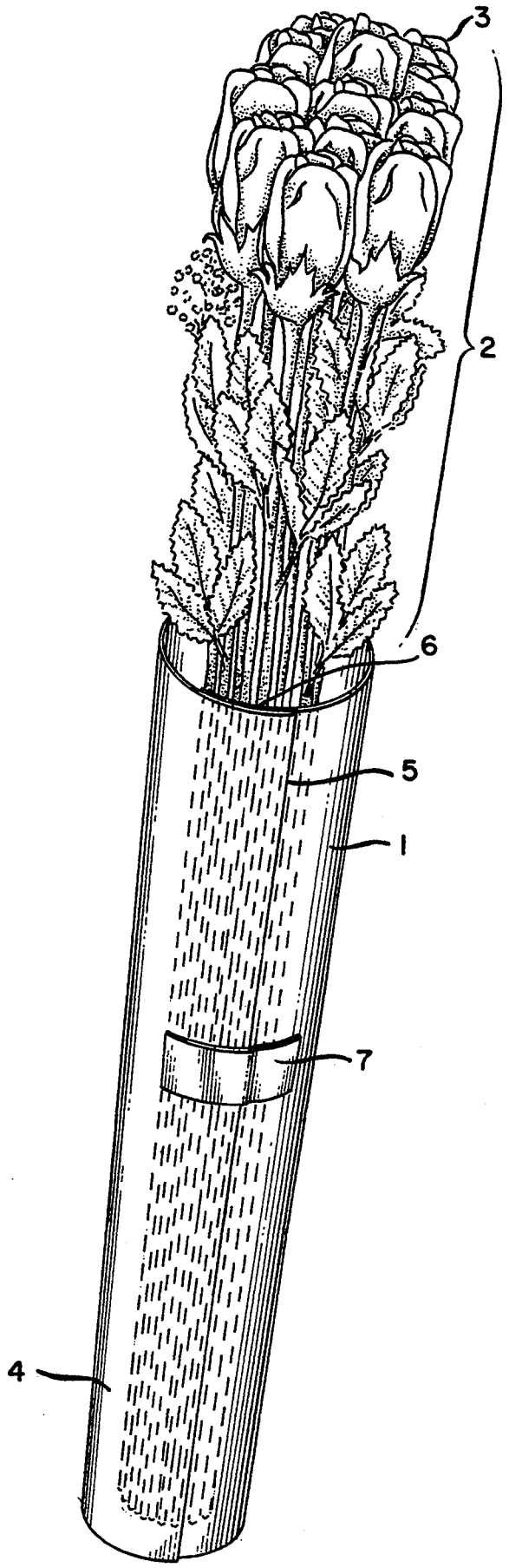
FIG. 1 is a showing of the wrapping of this invention applied to the stems of a floral arrangement.

Looking now specifically at the drawings which are an integral part of this specification and invention, FIG. 1 shows the wrapper of this invention 1 wrapped around a floral arrangement or grouping 2. In this showing, the floral arrangement has an upper, flowered portion 3 and stems 4 shown by dotted lines behind the wrapper. Ends 5 and 6 of the wrapper are held in a closed position by tab 7. By floral arrangement or grouping I mean any item that contains flowers and the like, either natural or artificial. These will include flowers that are sold with a plurality of stems or even a single stem with or without a pot element attached thereto.

Figure 2:
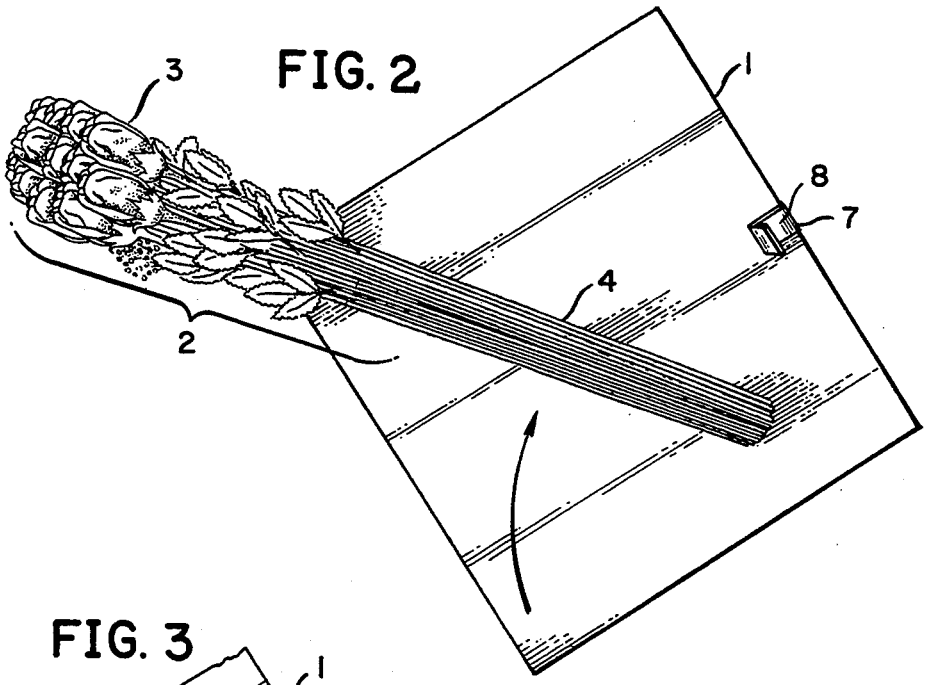
FIG. 2 is a showing of the process or method of wrapping a floral arrangement using the wrapping material of this invention.

FIG. 2 shows the floral arrangement 2 just prior to wrapping within the wrapper 1. The tab 7 is shown here just prior to being pulled by end portion 8 in order to open. Wrapping of the floral arrangement takes the route shown by the arrow in this figure.

Figure 3:
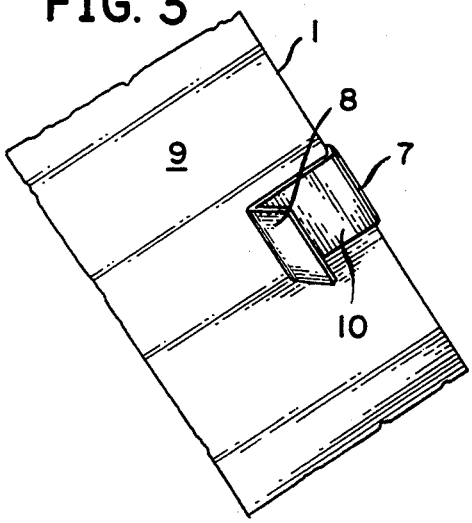
FIG. 3 is a detail showing of a preferred embodiment of the tab closure used to closer the quick wrap material of this invention.

FIG. 3 is a detailed showing of the location of tab 7 on the upper surface 9 of the wrapper 1. The end portion 8 of tab 7 is also shown more clearly. By pulling on the end portion 8 of tab 7, second portion 10 will be removed and the pressure sensitive adhesive contained thereunder, exposed.

Figure 4:
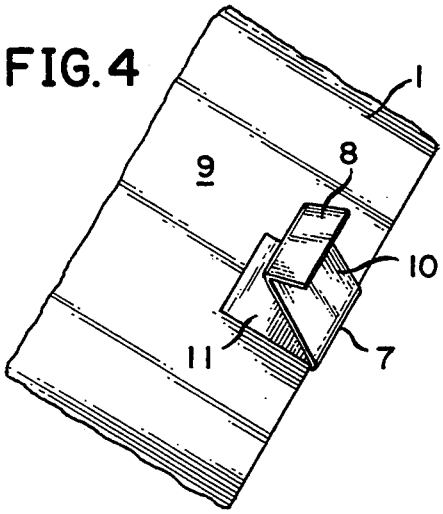
FIG. 4 is a closer view of FIG. 3.

FIG. 4 is another detailed showing of the tab closure element of this invention 7 which is located on upper surface 9 of the wrapper 1. By pulling on end portion 8, the second portion 10 is removed from the first portion 11 which exposes the pressure sensitive adhesive coated thereon.

Figure 5:
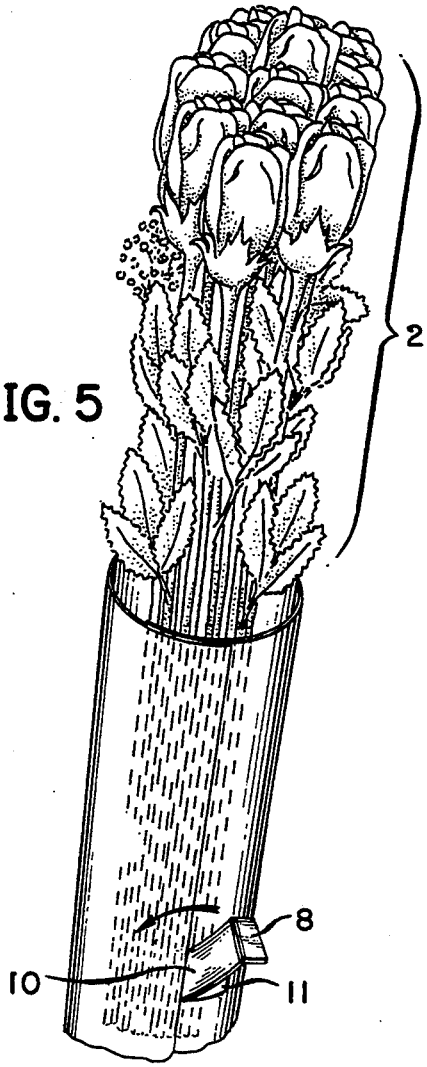
FIG. 5 is another view of the process or method of wrapping a floral arrangement using the wrapping material of this invention.

In FIG. 5, the floral arrangement 2 has been rolled in the wrapper 1 and the pressure sensitive adhesive located on tab 7, between second portion 10 and first portion 11 is thus exposed and can be placed over onto the under surface 12 insuring complete closure of the ends. The tab moves in the direction of the arrow as shown in this figure.

The wrapping material can be cut to any desired size. Conventionally, for example, the floral industry would use wrapping sheets ranging in sizes of about 5 by 5 inches to about 40 by 40 inches to wrap up typical floral arrangements. There are a host of materials that can be used to wrap items such as floral arrangements. These include foils, papers, organic films such as cellophane, polypropylene, polyethylene or combinations or laminates of such materials. Most of these materials have a thickness of from 0.50 mils to 4.0 mils with 0.60 to 2.0 mils being preferred. These materials should be flexible enough to wrap any desired element. When used for floral wrappings, polypropylene is a particularly preferred wrapping material. Decorative stenciling or labels or advertisements may be applied to these wrappings to enhance the product further.

The unique, tab closure device used within the metes and bounds of this invention is a bi- or tri-fold strip which is partially adhered to one side and at one end of the wrapping material described above. By partially adhered, I mean that only a portion of this strip, which represents the tab closure, is firmly attached to one side of this material. Usually, this strip is applied about the middle of the material or sheet of material. Then, a thin coating of a pressure sensitive adhesive is applied to a portion of the remainder of this tab. This pressure sensitive adhesive will adhere less to the tab itself than the material used for wrapping. Thus, when the portion of the tab coated with the pressure sensitive adhesive is folded over onto the other portion of the tab, it will stay folded until gently pulled loose during use. However, when the adhesive coated portion of the tab is applied to the sheet of material, it will hold firmly enough to result in closure of the wrap.

Pressure sensitive adhesives are well-known in the prior art. These include acrylics, rubber resins, vinyls, acetates, various types of polymeric adhesives and others too numerous to mention. Most of these materials are available commercially and are simply applied as a thin coating. Sometimes, activators are added to the adhesive composition. When pressed hard, or heated in any way, the activator enhances the tackiness of the pressure sensitive adhesive material. Thus, they are tacky and yet will release when in contact with some substrates. Thus, in the case of this invention, the adhesive will release when the coated layer is contacted loosely with the tab element but will adhere strongly when contacted under pressure with the wrapping materials mentioned above. The material used in the manufacture of the tab include some coated papers or synthetics such as polypropylene.

In a particularly preferred mode of operation, a sheet of polypropylene of about 15 in. by 24 in. and 1.0 mils thick was prepared for the wrapping of a floral arrangement. In this case, a 1 in. by 1.5 in. tab of polypropylene as cut and about ⅓rd of the length of this tab firmly glued to the middle of one end of this sheet of wrapping material and about the middle thereof. A thin substratum of a pressure sensitive adhesive acrylic was prepared and coated on much of the remainder of this tab. A smaller portion of this end of the tab was left uncoated with adhesive as was the surface of that portion glued to the wrapping material. The tab was folded so that the adhesive containing portion rested on top of that glued to the wrapping material and the uncoated end of this portion was folded again to provide a pull-tab. By looking at FIG. 4, the details of this part of the process are self-evident. Thus, the portion 11 is firmly attached to the surface of the wrapping material 1 and the pressure sensitive adhesive is applied to the lower surface of portion 10. A small pull tab 8 is left uncoated with pressure sensitive adhesive. When 10 is pressed down on 11 the two portions are temporarily held together by the adhesive. However, when the floral arrangement has been wrapped therein, a gentle pull on the pull tab will cause release of the adhesive layer. Then, the adhesive portion of the tab can be placed firmly over the two ends of the wrapped flowers and form a neat and convenient closure thereof.

There is no necessity to reach for anything else during this process. The user does not need string or rubber bands or twisters or external tapes and there is no necessity for pulling a cover sheet off and disposal thereof. Since each sheet is individual and does not need to be pulled off one from the other, there is a considerable savings in time and energy. My process is fast and simple and will result in a neat and firm closure of the wrapped item.

It should be noted here that the wrapping material of this invention, which contains the unique closure tab, may be used for the wrapping of any item. It is not limited to floral arrangements and groupings and the like. Anywhere there is a need for quick wrapping an item and sealing that wrapping along one edge thereof, my unique system will find utility.

I claim:

1. A method for wrapping an object comprising the steps of:

providing a sheet of material having an upper surface and a lower surface, a first end and a second end;

providing a tab closure element for said sheet, said tab closure element comprising two sides and having at least two sections, said tab closure element being adhered firmly by the first side of the first section of said tab closure element on said upper surface at said second end of said sheet of material;

coating the second section of the second side of the second section of said tab closure element with a pressure sensitive adhesive and folding said section so as to contact said first section on the second side thereof;

placing the object on said upper surface of said sheet and between said first and said second ends thereof;

wrapping said object by disposing said sheet about said object;

pulling the second section of the tab closure element from said first section leaving the pressure sensitive adhesive coated thereon; and, closing said sheet by unfolding said second section of said tab element from said first section of said tab element and contacting said adhesive on said second section with the second end of said sheet of material, so that said sheet is closed firmly around said object.

2. The method of claim 1 wherein said tab is formed into three sections, wherein the first and said second sections are substantially equal and the third section is smaller that either the first and second sections, and wherein adhesive is applied only to the second section.

3. The method of claim 2 wherein said object to be wrapped is a floral arrangement.

4. The method of claim 3 wherein said sheet of material is selected from the group comprising papers, foils and organic films.

5. The method of claim 4 wherein said sheet of material has a thickness of from 0.5 mils to 4.0 mils.

6. The method of claim 5 wherein said pressure sensitive adhesive is selected from the group comprising acrylics, rubber resins, and vinyls.

7. The method of claim 6 wherein said sheet of material has a dimension of from 5 in. wide to 40 in. wide and from 5 in. in length to 40 in. in length.

8. A method for the wrapping of a floral arrangement comprising a group of flowers having floral ends and stem ends, comprising the steps of:

a) taking the sheet of claim 2 and arranging the stems on the upper surface and on an end away from that end having the tab closure device adhered thereto, b) rolling said flowers along the upper surface of said sheet towards said end having the tab closure device adhered thereto until the tab closure device is reached, c) pulling the smaller, third section of the tab to expose the pressure sensitive adhesive coated on the second section; and d) placing the exposed pressure sensitive adhesive over the sheet of wrapping material.

whereby secure closure of the wrapping material around the floral arrangement is achieved.

* * * * *